US006402063B1

(12) United States Patent
Turner et al.

(10) Patent No.: US 6,402,063 B1
(45) Date of Patent: Jun. 11, 2002

(54) HEAD FOR SPRAYING APPARATUS

(75) Inventors: Leonard C. Turner, Modesto; Elroy G. De Winkle, Ripon, both of CA (US)

(73) Assignee: Progressive Ag, Inc., Modesto, CA (US)

( * ) Notice: Subject to any disclaimer, the term of this patent is extended or adjusted under 35 U.S.C. 154(b) by 0 days.

(21) Appl. No.: 09/562,428

(22) Filed: May 1, 2000

(51) Int. Cl.[7] ..... B05B 5/00

(52) U.S. Cl. ..... 239/706; 239/77; 239/419; 239/424; 239/690; 239/704; 47/1.7; 361/226; 361/228

(58) Field of Search ..... 239/77, 418, 419, 239/422, 423, 424, 428, 589, 690, 704, 706, 708; 47/1.7, 48.5; 361/225, 226, 228, 235

(56) References Cited

U.S. PATENT DOCUMENTS 3,212,211 A * 10/1965 Bennett ..... 239/706
4,219,864 A * 8/1980 Grunenfelder et al. .. 239/704 X
4,381,533 A * 4/1983 Coffee ..... 361/228
4,666,089 A * 5/1987 Inculet ..... 239/77 X
4,673,132 A * 6/1987 Inculet et al. ..... 239/706
4,762,274 A * 8/1988 Burls et al. ..... 239/77 X
5,402,945 A * 4/1995 Swanson, Jr. ..... 239/706
5,564,628 A * 10/1996 Hall et al. ..... 239/77 X

* cited by examiner

*Primary Examiner*—Steven J. Ganey
(74) *Attorney, Agent, or Firm*—Donald D. Mon

(57) ABSTRACT

A spray head for a spraying apparatus comprising a body formed as a conduit leading from an inlet end to a discharge end at which it forms a discharge pattern. A high velocity stream of air is injected into the head at its inlet end and flows through the conduit to its discharge end. Adjacent to the discharge end, a rank of injection nozzles injects liquid into the air stream, and adjacent to the nozzles, a rank of electrodes is formed as ports in the wall of the conduit.

9 Claims, 2 Drawing Sheets

HEAD FOR SPRAYING APPARATUS

FIELD OF THE INVENTION

A head for spraying apparatus which discharges a high velocity stream of atomized electrostatically charged liquid droplets.

BACKGROUND OF THE INVENTION

Apparatus to atomize, electrostatically charge, and discharge a high velocity stream of air and charged liquid droplets (a "fluid" stream) in an orderly pattern is known. Among the advantages of such apparatus in agricultural applications is the property of the charged droplets to deposit on all surfaces, top and bottom of leaves for example. This gives maximum coverage and protection for the plant or crop which is sprayed. An example of one known apparatus for this purpose is shown in Inculet et al U.S. Pat. No. 4,673,132. Spraying apparatus according to this instant invention offers advantages not provided by the Inculet sprayer.

The conditions of use of crop spraying equipment are often quite severe. Generally the spray heads are heavy and are supported on booms or arms. In use they can and do hit on hard surfaces, which tend to damage the head structure. Ordinarily dents and penetration of agriculture equipment surfaces are not objectionable. However, electrostatic sprayers involve situations which are not ordinary. They operate at high voltage such as 12,000 volts, and the operator must be protected from them. Also, correct distribution of the droplets is essential in order that all plant surfaces in range are properly and uniformly covered. For this, precise conduit and nozzle dimensions are essential. A dent, deformation, or perforation can result in a substantial loss of efficiency wherein portions of the flow might not be suitably supplied with an additive such as an insecticide, or the spray pattern may not be correctly formed, or if it is, the electrostatic charge may not be optimally consistent.

Spray heads of this type are frequently made of fiberglass. This material is useful because it has insulating properties. However, it does have the tendency to pick up moisture, and is readily deformable. This can result in undesirable degradation of the quality of discharge as well as the pattern of the discharged stream.

In addition there is a rather unexpected consequence of the use of fiberglass. These spray heads are generally used near combustion engines and some of their exhaust gases, in which substantial amounts of carbon are contained, reach the intake of the spray apparatus. Over a period of time which really is not very long, layer of carbon soot becomes lodged on the fiberglass surface which is practically impossible to remove. Ultimately it results in shorting out of the circuitry, or at least in degradation of performance. Even more the plexiglass tends to be porous, permeable and have a rough surface. The roughness of surface can have an undesirable affect on what should be a smooth flow. The permeability can result in carry-over of traces on previous usage to the next.

In contrast, the smooth, hard surfaces of this invention are interrupted only by readily cleaned electrode surfaces. They do not harbor carbon deposits in small craters because there are none. They are non-porous and not readily damaged or deformed.

As a further advantage, the discharge configuration and the electrode configuration can be changed by the simple replacement of one small part of the structure (the panel), and it can be adjustable if desired. When a fiberglass nozzle is used, it is necessary to change the entire structure.

It is an object of this invention to provide a spray head for an electrostatic sprayer which is structurally resistant to deformation and penetration, which is readily cleaned, and which can readily be manufactured accurately and economically.

Another object of this invention is to provide a panel bearing the electrodes for charging the droplets, which can readily be manufactured in an assortment of channel shapes, sizes, and electrode patterns, which can economically be manufactured, replaced if damaged, and adjusted or replaced with another shape to provide different spray patterns.

BRIEF DESCRIPTION OF THE INVENTION

A spray head for spraying apparatus according to this invention comprises a body formed as a conduit leading from an inlet end to a discharge end at which it forms a discharge pattern. A high velocity stream of air is injected into the head at its inlet end and flows through the conduit to its discharge end. Adjacent to the discharge end, a rank of injection nozzles injects liquid into the air stream, and adjacent to the nozzles, a rank of electrodes is formed in the wall of the conduit.

The body is a rigid metal structure, adapted to be attached to a supporting mechanism such as a boom for manipulation. Its internal surfaces are disposed and arranged to direct a rapidly-moving air stream toward the discharge end. A plurality of injector nozzles is mounted to the body adjacent to the discharge end. These nozzles inject liquid into the conduit, there to be sheared by the air stream and form a myriad of small droplets to be distributed throughout the air stream. The air stream also flows past electrodes to become electrostatically charged.

A feature of this invention is to provide a separable panel adjacent to the discharge end. It forms part of the wall of the conduit at the discharge end. It exposes on its inside surface a plurality of electrodes. This panel is comprised of an electrically conductive hard metal, for example 316 stainless steel, with an adherent and tough cover of insulation. This panel is highly resistant to deformation, and the cover is highly resistant to penetration.

The panel is fitted to and attached to the body. It is externally insulated, so the body need not itself be coated with insulation. As structure, the panel is initially completely covered by the tough layer of insulating material. The panel includes a plurality of electrodes formed as ports, comprising the metal structure exposed through openings formed in the insulating layer. The metal structure is connected to a source of voltage. These electrodes are patch-like, and are exposed to the air stream.

According to a feature of the invention, the ports are formed by milling away the insulating layer to expose correctly-shaped and correctly-located electrodes. Thus panel blanks can be made to provide different numbers, shapes, and arrangements of electrodes merely by milling away some of the insulating material at the appropriate locations and then using the correct panel.

According to a preferred but optional feature of the invention, the panel is trough-like with a pair of side walls for adjustable attachment to the body.

The above and other features of this invention will be fully understood from the following detailed description and the accompanying drawings, in which:

DETAILED DESCRIPTION OF THE INVENTION

Figure 1:
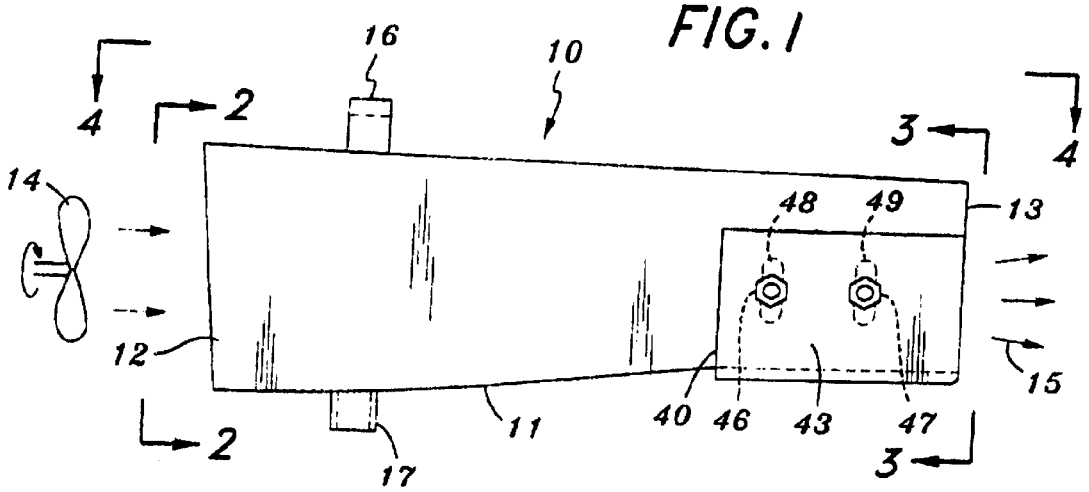
FIG. 1 is a side view of the presently-preferred embodiment of a spray head according to the invention.
Figure 2:
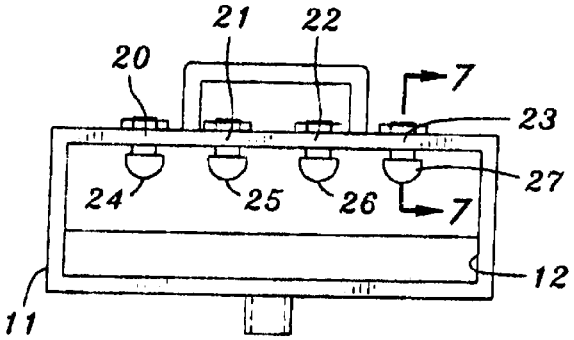
FIG. 2 is a left hand end view of FIG. 1.
Figure 3:
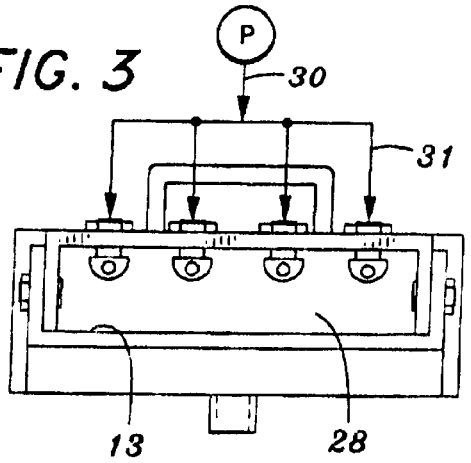
FIG. 3 is a right hand end view of FIG. 1.
Figure 4:
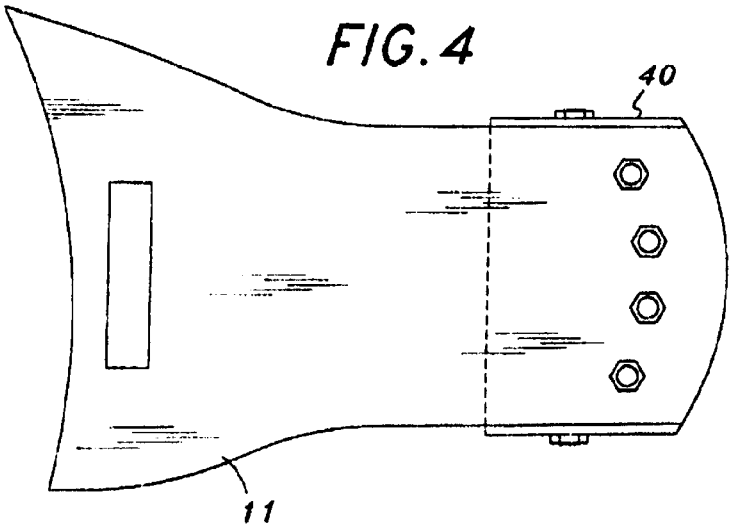
FIG. 4 is a top view of FIG. 1.

Spray head 10 is a metal body 11 formed of a strong and hard metal such as 316 stainless steel preferably having a coat of paint for good appearance and better wear. It has a smooth impermeable internal wall. This body need not be insulated, inside or out, because it is not connected to a source of electricity.

Body 11 has an inlet end 12 and a discharge end 13. Air is blown into the spray head by an attached blower 14, into the inlet end. It is discharged as a droplet-laden stream 15 from the discharge end.

A handle 16 is attached to the top surface of the body for convenience. A threaded socket 17 is fixed to the bottom for attachment of the apparatus to a boom or other manipulating or support structure.

Apertures 20, 21, 22, 23 through the top of the body are formed to receive nozzles 24, 25, 26, 27 and support them in the conduit 28 formed through the spray head. The number of nozzles and apertures is determined by the intended use and capacity of the spray head. A respective nozzle is provided for each of the individual electrodes to be described below.

Figure 7:
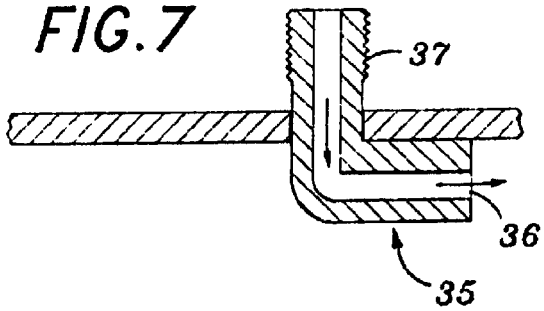
FIG. 7 is a cross-section of a nozzle used in the head.
Figure 8:
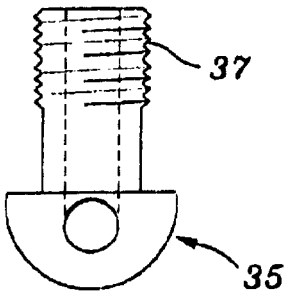
FIG. 8 is a side view of the nozzle of FIG. 7.

The shape and configuration of the nozzles is arbitrary. An inlet tube 30 receives water from a valved supply and manifold 31. The nozzles inside the conduit receive wafer under pressure and discharge it into the stream, discharging downstream so the airstream shears the entering water to form droplets. The stream will usually include additives such as insecticides, fungicides or fertilizers, in a rather dilute solution. A simplified nozzle 35 is shown in FIG. 7 and 8, wherein entering water is directed through an orifice 36 almost axially into the stream. The orifice exits near to the wall of the body, and water from it is sheared into the stream to form a stream of fine droplets. The nozzles have a supporting neck 37 from which they can be placed adjustably inside the body relative to the wall.

Figure 6:
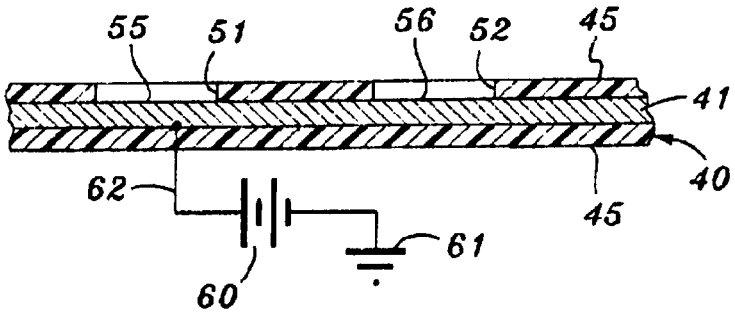
FIG. 6 is a fragmentary cross-section taken at line 6—6 in FIG. 5.

A panel 40, formed of a strong, hard, electrically conductive metal central layer 41, for example of 316 stainless steel with suitable thickness for structural strength, has a base 41 and two side walls 42, 43. This panel is made structurally very strong so as to be shape retentive against blows. It is coated on all sides with an outer insulating layer 45 (FIG. 6). This layer may be made of any suitable insulating material, but is preferably a baked-on material having some limited flexibility without cracking. It is also firmly adherent to the base material, resists penetration, and is smooth so as to be readily cleanable. Further details about this layer are given below. The metal layer is strong to resist damage and deformation by blows.

The side walls have holes 46, 47 to receive fasteners such as nut/bolt assemblies that are passed through aligned slots 48, 49 in the side walls of the body. In this way, the panel can provide for some adjustment of the size and shape of the discharge end, and also for some adjustment of the angle of the base, thereby to provide adjustability of the spray pattern. It also allows for replacement of a panel with one shape and electrode configuration and number with a panel of other shape and electrode shapes and numbers, as well as for other pattern shapes. In the event of several damage it can readily be replaced.

The material of insulating layer 45 must, of course, be suitably thick and have dielectric properties which will protect the user from the high voltages that are used. A voltage on the order of 12,000 volts is to be expected. It must be resistant to puncture, chipping and cracking. A smooth surface is much to be desired. It must be strongly adherent to the suitably cleaned metal surface, preferably one which has been grit-blasted.

The presently preferred material is a functionalized polyethylene co-polymer provided as a powder which can be deposited on a hot metal surface, melted to form a continuous layer adherent to the metal. A second layer and subsequent layers sufficient to provide insulation and strength can similarly be applied, and the part then allowed to cool.

The presently preferred material is sold by PFS Thermoplastic Powder Coatings, 3400 West 7th, Big Spring, Tex. 79720 under its trademark POLYARMOR.

The air stream of droplets is electrostatically charged by passing air over a set of electrodes. These electrodes are individually aligned with nozzles.

Figure 5:
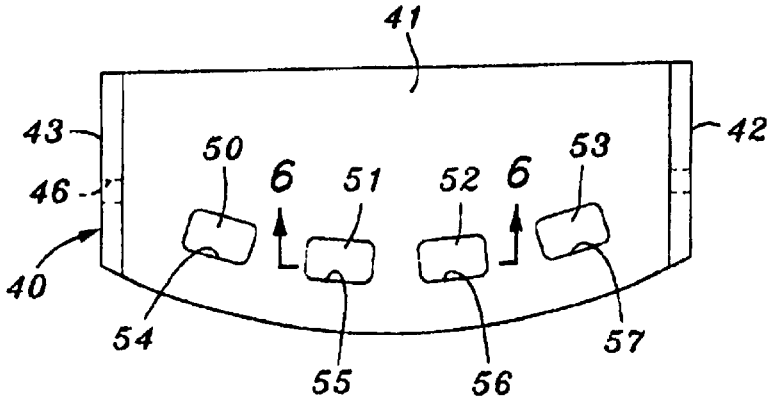
FIG. 5 is a top view of a panel used in FIG. 1.

Previous spray heads have usually provided electrodes as separate structural members, causing problems of wear and separation. This invention overcomes these problems by providing the electrodes as integral portions of the basic structure itself. As shown in FIGS. 5 and 6, these electrodes are exposed by forming ports through the insulating layer, exposing the metal. These electrodes are readily formed by the use of an end mill to remove insulation from areas where an electrode is to be formed, thereby exposing the metal of the central layer where the electrode is intended to be located. Advantages attainable by varying the shapes of the electrode are evident.

As examples, four electrodes 50, 51, 52, and 53 are shown, exposed through ports 54, 55, 56 and 57, respectively. These are generally axially aligned with respective nozzles, although precise axial alignment is not necessary. The illustrated shapes are arbitrary. They are rectilinear with rounded corners. Other shapes can readily be made to suit the individual circumstances, and they need not all be alike.

A power supply 60 is grounded at 61, and connected to the central layer 41 by a lead 62 as shown. Typical current limiters (not shown) will be included in the circuitry to protect the operator. The circuity itself forms no part of the invention.

The spray head shown is versatile and resistant to wear. It can readily be cleaned. The electrodes are conveniently formed to any desired pattern and number, and the spray pattern is adjustable by moving the panel relative to the body. These are all substantial advantages in a device intended for strenuous usage.

It will be observed that the electrodes and nozzles are on opposite sides of the conduit. Also that, while they are about equally aligned relative to the stream, the electrodes are not generally placed directly in the stream from the nozzles. It is not desirable for the water to impinge on the electrodes, but instead it is intended to enter air which already is in or is very near to an electrostatic field. Then the droplets will all have the same charge so they will repel one another and distribute through the stream and finally form a cloud of substantially uniform concentration of droplets.

The use of this spray head, especially when the spray head is mounted on a moving tractor, will soon notice that compared to the effects or previously known spray heads, the plant surfaces are more uniformly coated on all sides, and the there is less of the fluids on the ground and on the driver.

This invention is not to be limited by the embodiments shown in the drawings and described in the description, which are given by way of example and not of limitation, but only in accordance with the scope of the appended claims.

We claim:

1. A spray head to produce a stream of finely divided electrostatically charged water droplets, comprising:

a hollow rigid body having impermeable walls forming a conduit with an inlet end and a discharge end to receive and discharge an air stream;

a panel including a base and a pair of side walls, said base and said side walls all comprising a central layer of rigid electrically conductive metal, said conductive metal having oppositely facing surfaces, an insulating layer of insulating material coating said surfaces, said layer being strongly adherent thereto, ports formed through said insulating layer to expose selected areas of said metal facing into said conduit thereby to form electrodes exposed to said air stream, and an electrical contact connected to said central layer;

a plurality of nozzles attached to said body, said nozzles opening inside said conduit and being so disposed and arranged as to inject water into said conduit where it will be sheared into said air stream; and fasteners attaching said panel to said body.

2. A spray head according to claim 1 in which said insulating layer is a thermoplastic organic material strongly adherent to the central layer.

3. A spray head according to claim 2 in which said body and the side walls of said panel have openings which selectively enable said fasteners to position said panel at a plurality of relative positions so as to adjust the shape and pattern of the discharge streams.

4. A spray head according to claim 3 in which the inside walls of the body and of the panel are smooth and non-porous.

5. A spray head according to claim 2 in which said nozzles and said electrodes are substantially aligned relative to the flow of air and in which they face one another across the conduit.

6. A spray head according to claim 1 in which said body and the side walls of said panel have openings which selectively enable said fasteners to position said panel at a plurality of relative positions so as to adjust the shape and pattern of the discharge stream.

7. A spray head according to claim 1 in which the walls forming the conduit inside said body are smooth and non-porous.

8. A spray head according to claim 7 in which said rigid body is made of a hard metal.

9. In combination; a spray head according to claim 1, and a source of electrical potential connected to said central layer.

* * * * *